US009718244B2

(12) United States Patent
Fryman

(10) Patent No.: US 9,718,244 B2
(45) Date of Patent: Aug. 1, 2017

(54) BEVERAGE CAN CRUSHER

(71) Applicant: Barry Wayne Fryman, Owingsville, KY (US)

(72) Inventor: Barry Wayne Fryman, Owingsville, KY (US)

( * ) Notice: Subject to any disclaimer, the term of this patent is extended or adjusted under 35 U.S.C. 154(b) by 266 days.

(21) Appl. No.: 14/711,985

(22) Filed: May 14, 2015

(65) Prior Publication Data

US 2016/0332405 A1 Nov. 17, 2016

(51) Int. Cl.

| | |
|---|---|
| ***B30B 9/32*** | (2006.01) |
| ***B30B 1/00*** | (2006.01) |
| ***B30B 13/00*** | (2006.01) |
| ***B30B 9/30*** | (2006.01) |

(52) U.S. Cl.

CPC ..... *B30B 9/323* (2013.01); *B30B 1/008* (2013.01); *B30B 9/3014* (2013.01); *B30B 13/00* (2013.01); *Y10S 100/902* (2013.01)

(58) Field of Classification Search

CPC ..... B30B 9/321; B30B 9/323; B30B 9/3082; B30B 1/008; B30B 13/00; B30B 9/3014; Y10S 100/902

USPC ..... 100/35, 210, 229 A, 215, 218, 233, 293

See application file for complete search history.

(56) References Cited

U.S. PATENT DOCUMENTS

| | | | | |
|---|---|---|---|---|
| 2,760,268 A * | 8/1956 | Richards | A61C 5/68 | 100/116 |
| 3,299,802 A * | 1/1967 | Black, Jr. | B30B 9/323 | 100/233 |
| 3,780,647 A * | 12/1973 | Reimers | B30B 9/321 | 100/215 |
| 4,345,518 A * | 8/1982 | Cash | B30B 9/321 | 100/270 |
| 5,735,195 A * | 4/1998 | Hewitt | B30B 9/3082 | 100/210 |
| 7,546,965 B1 * | 6/2009 | Parkin | B02C 19/0093 | 100/210 |

* cited by examiner

*Primary Examiner* — Jimmy T Nguyen

(57) ABSTRACT

A free standing, portable and hand operated beverage can crushing apparatus to crush individual cans and allow them to drop into a storage container. Included is a rigid support frame that holds the angled crushing chamber where the cans are inserted. A lid is pivotally attached to the top of the support frame above the chamber. Attached to the lid is a ram that holds a roller head assembly that engages the can while the wheels on the roller head rotate across the end cap of the can as external force is continually applied to the lids extended lever arm in a downward motion causing the can to be crushed. The lever arm when raised slightly from the closed position will allow the crushed can to fall by gravity from the chamber into the receptacle that is capable of holding numerous cans.

8 Claims, 4 Drawing Sheets

BEVERAGE CAN CRUSHER

CROSS REFERENCE TO RELATED APPLICATIONS

Not Applicable

BACKGROUND—PRIOR ART

The following is a tabulation of some prior art that presently appears relevant:

U.S. Patents

| Pat. No. | Issue Date | Patentee |
|---|---|---|
| 4,212,242 | Jul. 15, 1980 | Willis |
| 4,345,520 | Aug. 24, 1982 | Goldsmith, et al |
| 4,394,834 | Jul. 26, 1983 | Lowe |
| 4,962,701 | Oct. 16, 1990 | Stralow |
| 5,058,498 | Oct. 22, 1991 | Chen |
| 5,293,816 | Mar. 15, 1994 | Musumeci |

Recycling of beverage cans has become more important than ever due to the increasing energy costs to produce the cans from raw materials and the fact the raw materials are ever depleting. Recycling of these cans voluntarily or mandated by government, begins with the user of the can.

It is desirable to make recycling convenient for the user of the beverage can so more will be recycled. A major inconvenience for the user that is recycling is storing the cans prior to delivery to the recycling center. Storing the cans in the original shape is a problem because the cans occupy much space with very little weight. It is desirable to crush the cans so they will take up only a fraction of the space of the original can.

There are can crushers available to aid the user in crushing the cans prior to recycling. Many of the previously designed crushers are undesirable because the manually operated mechanisms require much force. The force directed to crushing the beverage can is lost due to friction or interactions of the multiple moving parts of the prior art's units.

Many of the manually operated crushers were intended to be used on a table top or mounted to a wall as illustrated by Lowe in U.S. Pat. No. 4,394,834. I have found that it is not convenient to have to mount the crusher to structure or wall. It limits the ability of the user to place the crusher wherever they desire, such as where their household trash receptacle is located, possibly be away from a wall or counter.

Some of the can crushers are free-standing but are very complicated, bulky and expensive, Goldsmith, et al U.S. Pat. No. 4,345,520.

The most convenient crushers are designed to capture and store the crushed can as it falls under its own weight into a receptacle, without having to touch it once it has gone through the device as in U.S. Pat. No. 4,962,701 by Stralow. It is however desirable to have the ability to store enough cans to fill a normal sized kitchen garbage bag prior to emptying.

Some manual devices are capable of being attached to a receptacle, but end up being very large and bulky due to the amount of force required to operate the crusher as shown in Musumeci, Sr., et al U.S. Pat. No. 5,293,816. This limits the ability to locate the unit discretely within the home which is preferable.

SUMMARY

In accordance with one embodiment, a can crusher having a support base, a lid comprising a lever arm that is pivotally attached to the base, a crushing chamber, a ram with attached ram roller head, and a receptacle.

ADVANTAGES

Accordingly several advantages of one or more aspects are as follows: to provide beverage can crusher that is free standing on a typically flat floor, that is light weight and portable making it capable of being located as desired by the user, that is inexpensive to manufacture, thus making it accessible to more individuals, that applies as much of the manually applied force as possible to the crushing process, that allows the crushed can to fall freely into a receptacle. Other advantages of one or more aspects will be noticeable through the consideration of the drawings and following description.

DRAWINGS—FIGURES

Figure 1:
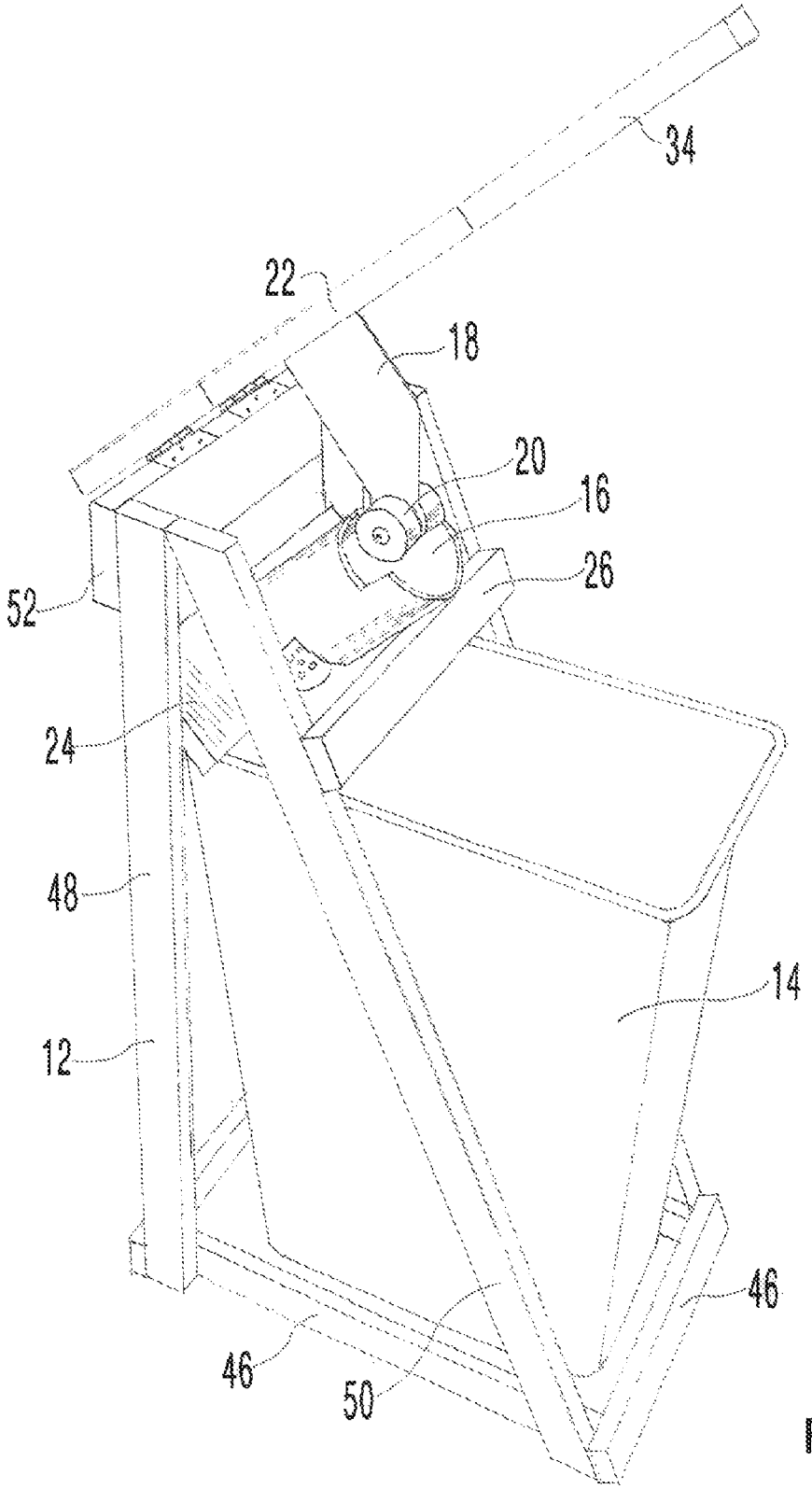
FIG. 1 is a perspective view of the can crusher with the lid in the partially raised position.

| Drawings - Reference Numerals | |
|---|---|
| 12 support Frame | 14 receptacle |
| 16 chamber | 18 ram |
| 20 ram roller head | 22 rotating lid |
| 24 rear horizontal beam | 26 front horizontal beam |
| 28 cut-out in chamber | 30 roller wheels |
| 32 axel-nut | 34 lever arm |
| 36 lid pivot-hinge | 38 end plate |
| 40 discharge opening | 42 slot |
| 44 aluminum beverage can | 46 floor base |
| 48 rear vertical member | 50 front angled member |
| 52 rear horizontal top beam | |

DETAILED DESCRIPTION—FIGS. 1, 2, 3

One embodiment of the beverage can crusher is illustrated in FIG. 1 (Perspective View). The can crushing apparatus includes a ridged, free standing support frame 12 that is constructed to be slightly less than waist tall. The frame is composed of a floor base 46, a pair of opposing rear vertical members 48, a pair of opposing front angled members 50, a rear horizontal beam 24, a rear horizontal top beam 52, and a front horizontal beam 26. The frame members are rigidly adjoined. The frame members can be made from a various selection of materials including wood, tubular steel, aluminum, or high strength plastics and adjoined by various methods and accessories.

FIG. 1 shows the receptacle 14 that stores the can opener tabs and the cans after they have been crushed. The receptacle is derived from using a typical trash bin or clothes type hamper and lining it with a standard plastic trash bag.

The chamber 16 which is sized to be just slightly larger than the diameter of a typical beverage can is attached to the rear horizontal beam 24 and resting on the front horizontal beam 26. The lid 22 is attached to the support frame 12 at the rear horizontal top beam 52 using a pivot mechanism 36. The lever arm 34 is the narrowed extended end of the lid 22.

Figure 2:
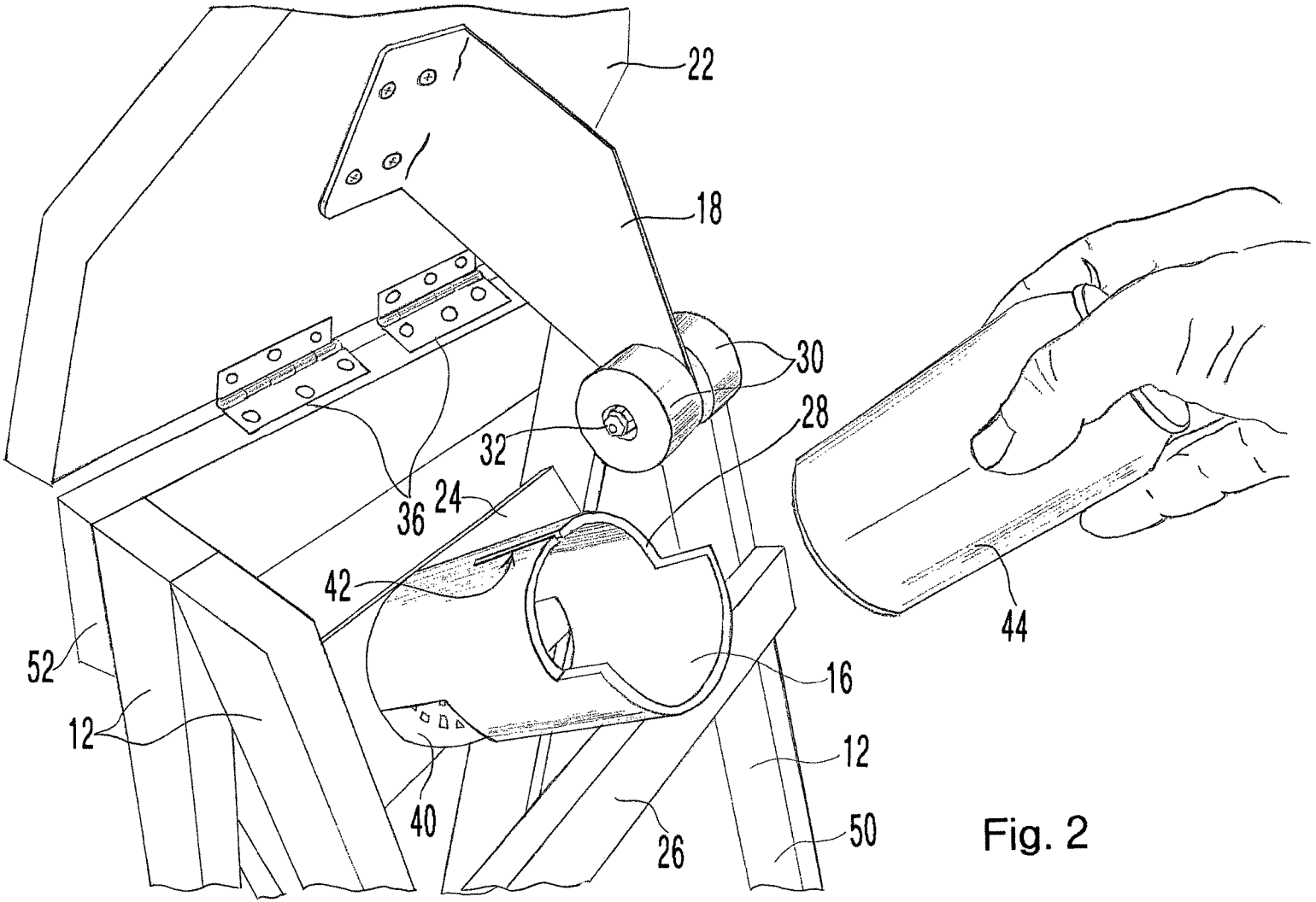
FIG. 2 is a fragmentary section showing how a can is placed in the chamber and detailing the crushing components.

As illustrated in FIG. 2, the ram 18 is rigidly attached to the lid 22. It is located at a defined distance from the pivot 36 which will allow it to enter the chamber 16 and the slot 42 when the lid 22 is swung closed. The ram is made of a thin (⅛") strong metal. At the end of the ram 18 is the ram roller head 20 which consists of an axel and lock nuts 32 that hold the roller wheels 30 which contact the can during crushing.

Figure 3:
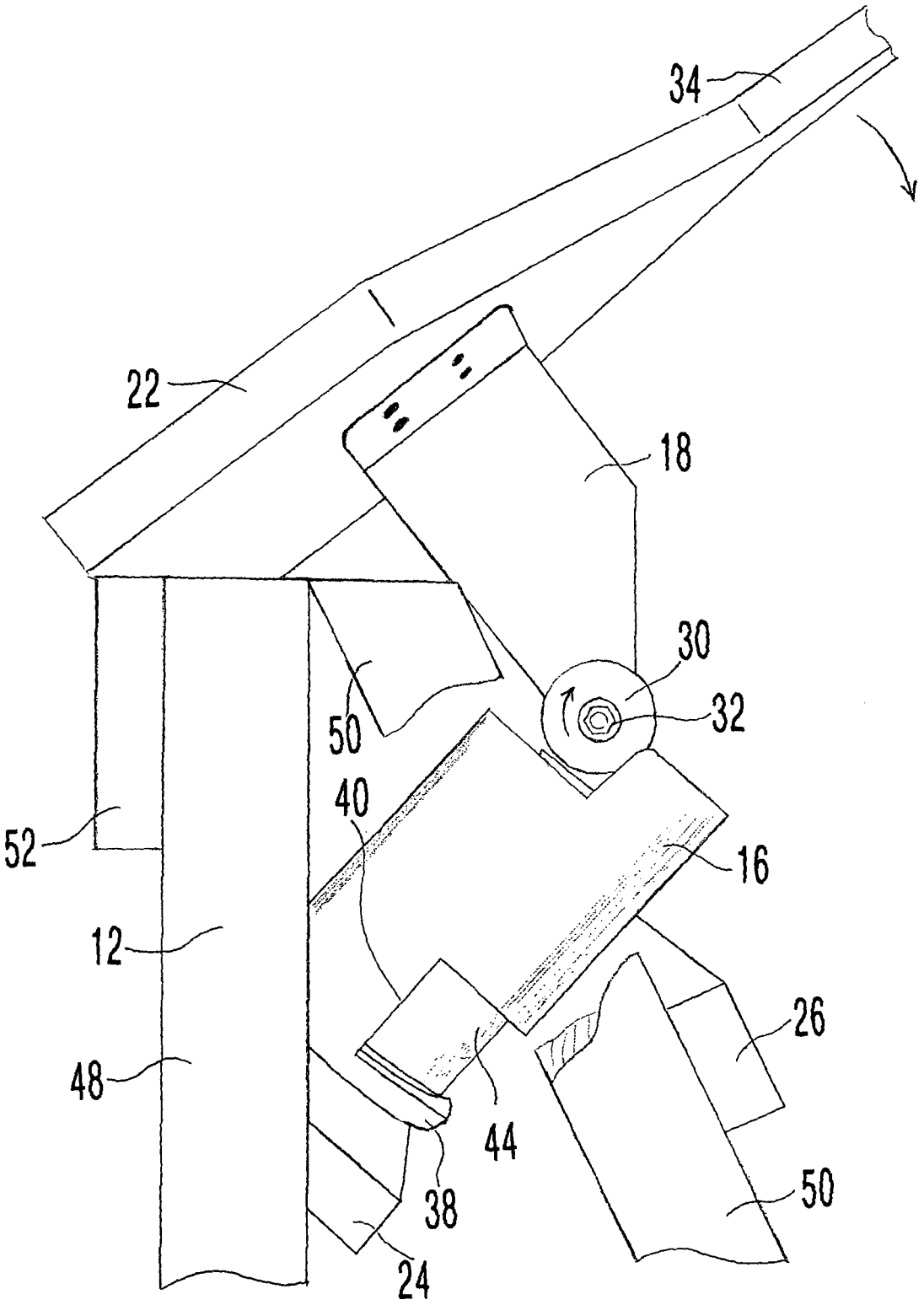
FIG. 3 is a fragmentary side view showing a can in the chamber ready to be crushed by applying downward force to the lever arm.

The chamber 16 is attached to the rear horizontal beam 24 by the end plate 38 that is the rear termini of the chamber as shown in FIG. 3. The rear horizontal beam 24 is constructed at a defined angle with the rear vertical plane of the support frame 12 and at a defined distance below the pivot 36 such that when the lid 22 is swung downward the ram roller head 20 enters the chamber 16 via the cut-out 28 and continues through the chamber to the final closed position without any contact between the ram roller head components and the chamber.

There is a cut-away 28 in the front upper half of the chamber 16 to allow the wheels 30 to enter the chamber and contact the beverage can 44 as the lid is brought forward. The slot 42 in the center of the top of the chamber 16 allows the ram 18 to pass through during the crushing process. There is a discharge opening 40 at the rear of the chamber 16 to allow the crushed can to fall freely, without attention, into the receptacle 14 once the lid 22 is raised slightly to remove the down force of the ram head on the crushed can.

Operation—FIGS. 1, 2, 3, 4

Figure 4:
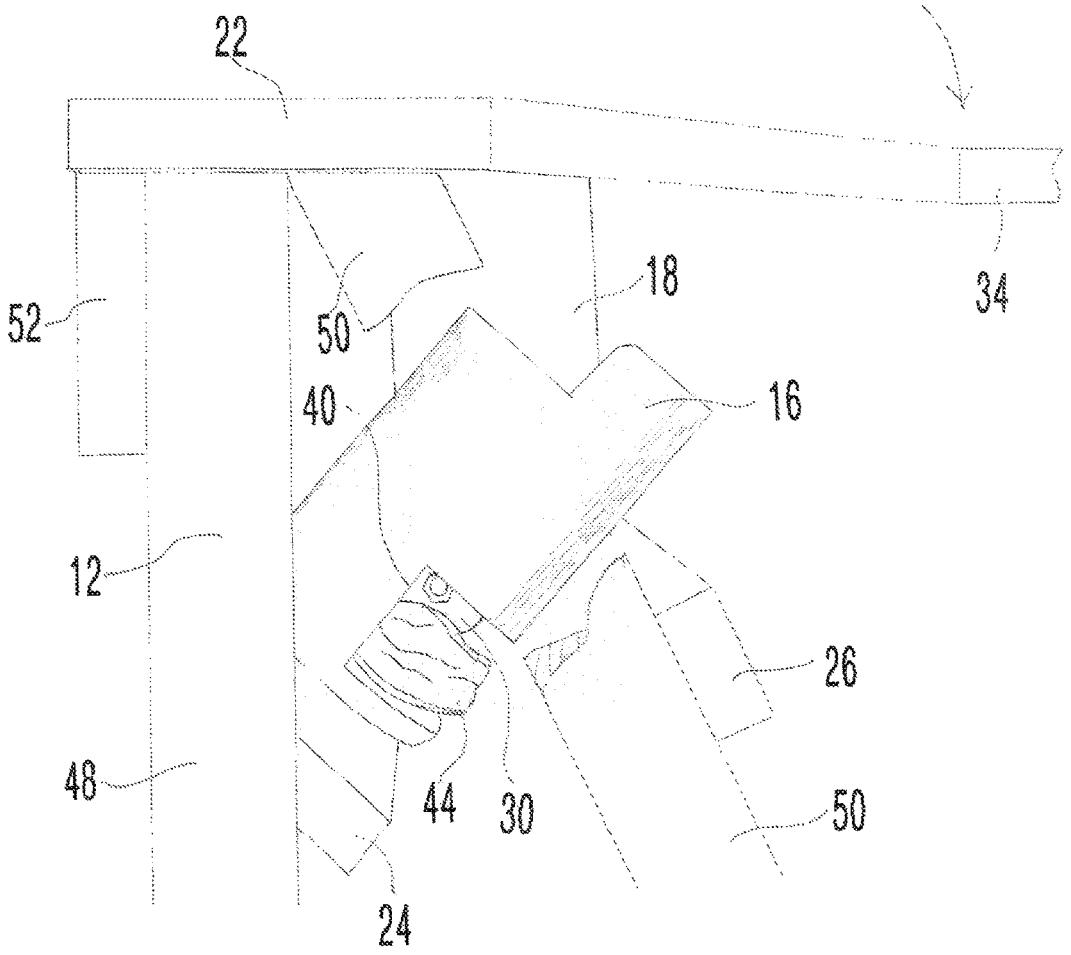
FIG. 4 is a fragmentary side view showing the final rest or closed position at the end of the crushing process.

As shown in FIG. 4, the apparatus is at rest with the rotating lid 22 in the horizontal or down position, with the underside against the top of the rigid support frame 12. The lid is designed to be a safety feature, that it covers the chamber 16 and does not permit access to pinch points.

The user would grip the lever arm 34 of the lid 22 and raise the lever arm, making the lid to move about the pivot 36 and continue to raise the lid to a near vertical position or open position as shown in FIG. 1. An aluminum beverage can 44 is placed into the chamber 16 as the lid is held in the open position as illustrated in FIG. 2. Once the can is inserted until it comes into contact with the end plate 38, the hand used to insert the can is cleared. The lever 34 is then swung downward and the roller wheels 30 make contact with the end cap of the beverage can as shown in FIG. 3. As the lever is continued to be forced downward, beginning the crushing process, the ram roller head 20 enters the chamber, the roller wheels 30 will rotate down the end cap of the beverage can while crushing force is transferred in the axial direction of the can and the ram roller head 20 travels toward the end plate 38. This continues until the lid reaches the closed position and the crushing limit is reached.

FIG. 3 depicts the rotation of the roller wheels 30 down the end cap of the aluminum can 44 as the ram 18 along with the lever 34 and lid 22 is swung through its crushing path.

From the closed position as shown in FIG. 4, the user can the raise the lever 34 slightly to allow the crushed can to freely drop without attention through the discharge opening 40 and into the receptacle 14, or the can be left in place until another can is need to be crushed and once the lever 34 is raised to gain access to the chamber 16 the previously crushed can will then fall.

When the receptacle 14 has been filled it can be taken from between the support frame 12 to allow the plastic bag full of crushed cans to be removed and a new bag installed and the receptacle placed back into position.

While the present invention has been shown and illustrated in terms of a specific apparatus, it is apparent that various modifications and changes in detail thereof may be made without departing from the spirit and scope of the invention.

Advantages

From the description above, a number of advantages of same embodiments of this can crusher become evident:

a) The free standing unit is light weight and portable which allows it to be located where the user desires.
b) The simple design is inexpensive to manufacture, making to accessible to more individuals.
c) Nearly all of the manual force applied to the lids lever arm is transferred to the crushing of the beverage can through the ram roller head without wasted energy.
d) The angled chamber and discharge opening allowing for free fall of the crushed cans is a major convenience factor.
e) Having a recycling receptacle incorporated allows storage of the cans and can opener tabs at the unit.
f) The crusher and receptacle is similar in size to a typical kitchen garbage bin, thus minimum space is required for the unit.

Ramifications

Although the description above contains much specificity, it should not be construed as limiting the scope of the embodiments but merely providing illustrations of some of several embodiments. For example, the crushers support frame could be made in similar configurations with various materials or it could be an enclosed, box-type rather than a member frame unit. The lever arm could be extending or telescoping type. Also, the chamber could be shaped differently—triangular, trapezoidal, or oval, and be made of a variety of materials as long as they can withstand forces applied to crush the cans and the capable of withstanding the scraping of the aluminum beverage can against the sides during the crushing process.

The invention claimed is:

1. A beverage can crusher comprising:

a support frame having a base, a plurality of rear vertical members, a plurality of angled front members and a plurality of horizontal beams, said rear vertical members are connected to said base at right angles, said angled front members are connected to said base at their bottom and to the rear vertical members at their top, and said horizontal beams connected to said rear angled front members together;

a generally planar lid having a narrowed front end to form a lever arm that is used to transfer manual force, said lid pivotally attached at the rear and top of the support frame;

a ram that is attached to the bottom of the lid;

a ram roller head attached at the bottom of the ram, said ram roller head having an axel attached to the ram and wheels attached to said axel; and a chamber that is larger than a diameter of a beverage can, said chamber attached to the frame on a predetermined angle to hold the can prior to crushing, and said chamber having an opening in a front to receive cans and a cut-out in an upper portion adjacent to the opening at the front the chamber for entry of the ram roller head, said chamber having a slot down the top for receiving the ram and a discharge opening near a lower end for compacted cans to exit.

2. The beverage can crusher according to claim 1, wherein said beverage can crusher is free standing when placed upon a typically level floor.

3. The beverage can crusher according to claim 1, further including a receptacle for holding crushed cans, said receptacle being free standing or attached to said frame below said chamber.

4. The beverage can crusher according to claim 1, wherein the beverage can crusher is portable.

5. A method of crushing a beverage can, the method comprising the steps of:

a. providing a can beverage crusher having a support frame, a lid comprising a lever arm pivotally attached to the frame, a ram that is attached to the lid, a ram roller head attached at the bottom of the ram, a receptacle, and a chamber attached to the support frame on a predetermined angle to hold the can prior to crushing, said chamber having an opening in a front to receive cans and a cut-out in an upper portion adjacent to the opening at the front the chamber for entry of the ram roller head, and said chamber having a slot down the top for receiving the ram and a discharge opening for compacted cans to exit;

b. raising said lid to allow access to said chamber;

c. dimpling the beverage can to be crushed by squeezing the sides of the can slightly between an index finger and a thumb to a depth of about one-half inch;

d. placing said beverage can in said chamber;

e. applying a downward manual force on said lever arm to allow said ram roller head to crush can; and f. lifting said lever arm to allow crushed can to drop into said receptacle.

6. The method of claim 5 wherein said beverage can crusher is free standing when placed upon a typically level floor.

7. The method of claim 5 wherein said receptacle being free standing or attached to said frame below said chamber.

8. The method of claim 5 wherein the beverage can crusher is portable.

* * * * *